US007287897B2

(12) United States Patent
Schertenleib

(10) Patent No.: US 7,287,897 B2
(45) Date of Patent: Oct. 30, 2007

(54) DEVICE AND METHOD FOR MIXING A SOLID AND A FLUID

(75) Inventor: Peter Schertenleib, Selb (DE)

(73) Assignee: Netzsch-Feinmahltechnik GmbH (DE)

( * ) Notice: Subject to any disclaimer, the term of this patent is extended or adjusted under 35 U.S.C. 154(b) by 0 days.

(21) Appl. No.: 11/499,455

(22) Filed: Aug. 4, 2006

(65) Prior Publication Data

US 2006/0268657 A1 Nov. 30, 2006

Related U.S. Application Data

(63) Continuation of application No. 10/486,634, filed as application No. PCT/EP02/09265 on Aug. 19, 2002, now abandoned.

(30) Foreign Application Priority Data

Aug. 17, 2001 (DE) ..... 101 39 413
Dec. 21, 2001 (DE) ..... 101 63 397

(51) Int. Cl.
*B01F 3/12* (2006.01)
*B01F 7/20* (2006.01)

(52) U.S. Cl. ..... 366/164.6; 366/178.1; 366/601

(58) Field of Classification Search ..... 366/30, 366/33–35, 37, 152.1, 152.2, 156.1, 157.4, 366/164.5, 165.1, 165.2, 172.1, 172.2, 175.2, 366/178.1, 178.2, 263–265, 601, 152, 2, 366/164.6

See application file for complete search history.

(56) References Cited

U.S. PATENT DOCUMENTS

| | | | | |
|---|---|---|---|---|
| 1,851,071 A | | 3/1932 | Travis | |
| 2,779,054 A | | 1/1957 | Doriat | |
| 3,606,270 A | | 9/1971 | Zimmerly | |
| 3,995,838 A | | 12/1976 | Zucker | |
| 4,106,117 A | | 8/1978 | Cloots | |
| 4,239,396 A | | 12/1980 | Arribau et al. | |
| 5,904,419 A | | 5/1999 | Arribau | |
| 5,932,270 A | * | 8/1999 | Rock et al. | 426/572 |

FOREIGN PATENT DOCUMENTS

| | | | |
|---|---|---|---|
| DE | 262813 | A1 | 9/1911 |
| DE | 436368 | C | 10/1926 |
| DE | 1067720 | C | 9/1955 |
| DE | 41822 | | 8/1962 |
| DE | 1272894 | B | 12/1964 |
| DE | 262813 | A1 | 8/1987 |
| DE | 19629945 | A1 | 7/1996 |
| DE | 10139413 | A1 | 8/2001 |
| EP | 0688598 | A1 | 6/1995 |
| GB | 1254825 | | 3/1969 |
| GB | 2229104 | A | 2/1990 |

* cited by examiner

*Primary Examiner*—David Sorkin
(74) *Attorney, Agent, or Firm*—Woodard, Emhardt, Moriarty, McNett & Henry LLP

(57) ABSTRACT

A device (10) for mixing a pulverulent or granular solid (13) with a liquid (32) comprises at least one solid supply device and at least one liquid supply device (37, 38, 40). In an acceleration chamber (42), a rotary movement is imparted to the supplied liquid (32) and the liquid (32) is accelerated to a pre-determined speed, while a rotary movement is imparted to the supplied solid particles (13) in a solid supply chamber (16). The device (10) further comprises a mixing chamber (76) for mixing the solid particles (13) with the liquid (32) to form a suspension, while maintaining the rotary movement generated previously. In a compressor chamber (78), the rotating suspension is accelerated so that a suction effect is generated in an entry region (82) of the compressor chamber (78), which suction effect at least substantially de-aerates the supplied loose solid (13).

18 Claims, 7 Drawing Sheets

DEVICE AND METHOD FOR MIXING A SOLID AND A FLUID

REFERENCE TO RELATED APPLICATIONS

This application is a Continuation of U.S. patent Ser. No. 10/486,634 filed Feb. 11, 2004 now abandoned and entitled DEVICE AND METHOD FOR MAKING A SOLID AND A FLUID which is the national phase of U.S. application based upon PCT/EP02/09265, filed Aug. 19, 2002, claiming priority from German Patent Application Serial No. 10163397.1, filed Dec. 21, 2001, and German Patent Application Serial No. 10139413.6, filed Aug. 17, 2001, all of which are hereby incorporated by reference.

The invention relates to a device for mixing a pulverulent or granular solid with a liquid. Such a mixing device is known from DE 196 29 945 C2. The invention relates also to a method for mixing a solid with a liquid.

When mixing a dry substance with a liquid, it is important for the production of a homogeneous suspension that the surfaces of the solid particles are completely wetted with the liquid. However, complete wetting of the powder particles with the liquid is made more difficult if the dry substance to be introduced into the liquid is in the form of a loose powder or contains agglomerates formed from the primary particles of the powder. In such a case, the free surface of the loose powder or of the agglomerates is rapidly wetted with the liquid, but the wetting process then slows down considerably because air enclosed in the capillaries of the loose powder or of the powder agglomerates hinders penetration of the liquid into the capillaries. To solve that problem, known mixing devices, in which the solid is supplied in the form of a loose powder or contains agglomerates formed from the primary particles of the powder, usually have devices for introducing shear forces into the solid/liquid suspension. By means of those shear forces, particles of the loose powder that are bonded together are separated, or powder agglomerates are comminuted, so that wetting of the newly formed free surfaces is possible.

In the mixing device known from DE 196 29 945 C2, a rotor is arranged in a mixing chamber, in which mixing of the solid with the liquid takes place, and a plurality of propeller-like mixing blades are secured to the rotor along a rotor axis A. Agglomerates contained in the solid are comminuted by the shear forces which are introduced into the suspension by way of the mixing blades and which are dependent on the rotor speed, so that intensive mixing of the liquid with the dry substance is possible. That known mixing device has the disadvantage that a high outlay in terms of energy is required in order to apply the necessary shear forces, especially when using highly viscous fluids or in the case of suspensions containing a high proportion of solid.

From DE 12 72 894 there is known a device for mixing a pulverulent material with a liquid. To that end, the housing of the mixing device has a cylindrical inlet channel for the powder. In the inlet channel, the two components are drawn into the dispersing chamber by a working cone which is equipped with mixing blades and has feed pipes for the liquid. The dispersing chamber is formed by a housing and a truncated cone which rotates in the housing. Both the truncated cone and the delivery cone with its mixing blades are driven by separately arranged drives in the stator part of the mixing device. The conical inner surface of the housing forms, with the conical rotor, a chamber having the shape of a truncated cone. At the end of that chamber are paddles, which convey the mixture away in the direction towards an outlet pipe.

DE 10 67 720 discloses a device for the thorough mixing of ceramics compositions. The device used therefor has a hopper followed by a screw conveyor, which conveys the ceramics material, which may previously have been comminuted, into a through-channel for the material. The through-channel tapers to the outlet owing to the different cone forms between the housing and the rotating cone surface of the rotor.

The object underlying the invention is to provide a device and a method for mixing a pulverulent or granular solid with a liquid, by means of which wetting of the powder particles with the liquid is enhanced.

That object is achieved according to the invention by a device according to claim 1 and a method according to claim 17. In the device according to the invention and the method according to the invention, a solid to be mixed with a liquid is introduced by means of at least one solid supply device into a solid supply chamber, where a rotary movement is imparted to the solid particles. The liquid is conveyed by at least one liquid supply device into an acceleration chamber. The liquid supplied by the liquid supply device may consist of one or more component(s) and the liquid may already contain a certain proportion of solid. In the acceleration chamber, a rotary movement is imparted to the liquid and the liquid is accelerated to a pre-determined speed. The liquid then flows into a mixing chamber, where it is mixed with the solid particles while the rotary movement generated previously is maintained. From the mixing chamber, the solid/liquid suspension is conveyed to a compressor chamber, in which the rotating suspension is accelerated.

Owing to the increased flow speed of the suspension in the compressor chamber and the resulting reduced static pressure, a suction effect is created in an entry region of the compressor chamber, so that the air in the capillaries of the loose solid or of the powder agglomerates is aspirated. As a result, the loose solid that is supplied is at least substantially de-aerated before it enters the compressor chamber and wetting of the powder particles with the liquid in the mixing chamber is enhanced.

An increased dynamic pressure also prevails in the compressor chamber owing to the increased flow speed of the suspension. As a result, the liquid no longer passes into the de-aerated capillaries of the loose solid or of the powder agglomerates solely as a result of capillary forces but is pressed into the capillaries under pressure. Accordingly, rapid and complete wetting of the powder particles with the liquid can be achieved even without the introduction of shear forces into the solid/liquid suspension. The device according to the invention can be used in the production of suspensions from solids and liquids for the low to high viscosity range.

According to a further development of the invention, the solid supply device comprises a pulsed feeding device for supplying the solid and sealing the solid supply chamber from the surrounding atmosphere. When the solid supply chamber is sealed from the surrounding atmosphere by a pulsed feeding device, a low pressure is produced in the solid supply chamber by the suction effect in the entry region of the compressor chamber. As a result, the solid particles that are supplied are already largely de-aerated in the solid supply chamber, as a result of which wetting with the liquid in the mixing chamber is enhanced. Moreover, the air in the capillaries of the powder agglomerates that are supplied expands, so that the agglomerates are at least partly destroyed and the free powder surface available for rapid wetting is accordingly increased. Furthermore, the air flowing to the entry region of the compressor chamber transports the powder particles into the mixing chamber, where they are ready to be mixed with the liquid. Examples of suitable pulsed feeding devices are a twin-chamber conveyor, a cellular wheel sluice, or a system having two rotatable ball valves and an intermediate chamber.

In order to impart a rotary movement to and accelerate the liquid in the acceleration chamber, the liquid supply device preferably comprises at least one inlet nozzle which is arranged tangentially relative to the direction of flow of the liquid in the acceleration chamber and is inclined in the direction of flow. Through the inlet nozzle, of which there is at least one, there may be supplied a pure liquid consisting of one or more component(s) or a liquid which already contains a certain proportion of solid. From four to six inlet nozzles are preferably provided. Furthermore, a device for pressurising the liquid to be supplied may also be present, in order to enhance the accelerating action. Suitable devices are, for example, a pump or an air pressure vessel.

The acceleration chamber preferably has a substantially circular cross-section and is separated from the solid supply chamber by a separating wall. In this preferred embodiment of the mixing device according to the invention, the acceleration chamber and the solid supply chamber may be arranged inside a cylindrical housing, the acceleration chamber surrounding the solid supply chamber. That arrangement allows the mixing device to be of compact construction.

Flow channels which extend spirally and are inclined in the direction of flow may be formed on a surface of the separating wall that faces the acceleration chamber and/or on a surface, facing the acceleration chamber, of an outer wall that delimits at least part of the acceleration chamber. The flow channels stabilise the rotary movement of the liquid and can be formed either by recesses formed in the separating wall and/or the outer wall or by webs attached to the separating wall and/or the outer wall.

In a preferred embodiment of the mixing device according to the invention, the separating wall and/or the outer wall that delimits at least part of the acceleration chamber and/or an outer wall that delimits at least part of the mixing chamber are rotatable. The rotatable arrangement of the above-mentioned walls makes it possible to maintain the speed of rotation of the liquid in the acceleration chamber and/or of the suspension in the mixing chamber, because braking of the rotary movement by the surface resistance of the walls is avoided. Such rotatable walls are advantageous especially in the processing of highly viscous or intrinsically viscous liquids.

The separating wall between the acceleration chamber and the solid supply chamber is preferably axially displaceable. As a result of an axial displacement of the separating wall (so-called auto bulkhead adjustment), the flow paths of the liquid or of the suspension in the acceleration chamber or in the mixing chamber, respectively, can be varied in dependence on the viscosity and flow behaviour of the liquid or suspension, in order to prevent an interruption of flow, for example. If the separating wall is displaced in the direction towards the compressor chamber, the flow path of the liquid in the acceleration chamber is increased, while the flow path of the suspension in the mixing chamber is reduced. If the separating wall is displaced in the opposite direction, the flow path of the liquid in the acceleration chamber is reduced, while the flow path of the suspension in the mixing chamber is increased.

In a preferred embodiment of the mixing device according to the invention, a rotor is provided which preferably has a first, a second and a third rotor section, the first rotor section being a section of the rotor that faces the solid supply device and is arranged in the solid supply chamber. The first rotor section may also be provided with a pre-treatment head which roughly comminutes the supplied solid agglomerates and accelerates them to a rotary movement. The pre-treatment head may be in the form of a comminuting screw. The first rotor section having the comminuting screw can be connected to the second rotor section by way of screw or plug connections, so that it can be made to rotate by the same drive as the other rotor sections. Alternatively, separate drives may be provided for the first and second rotor sections. The rotor can be operated at a speed of rotation of from 1500 to 2500 rpm and preferably at a speed of rotation of about 1500 rpm and can extend from an inlet region of the mixing device to the outlet region thereof.

The rotatable separating wall and/or the outer wall that delimits at least part of the acceleration chamber and/or the outer wall that delimits at least part of the mixing chamber is/are preferably connected to the rotor. By means of such an arrangement, the solid particles in the solid supply chamber and the liquid in the acceleration chamber and/or the suspension in the mixing chamber can be maintained in rotary movements that are synchronous with one another.

At least part of the second rotor section can extend into the solid supply chamber and be provided with pulverising blades. By means of the pulverising blades, the powder particles that are introduced are finely pulverised, so that the free powder surface available for rapid wetting is increased. Moreover, the solid particles are accelerated to a rotary movement by the rotation of the pulverising blades.

In a preferred embodiment of the mixing device according to the invention, the compressor chamber has a cross-section in the form of an annular gap and is delimited by an outer wall section in the form of a truncated cone and by the third rotor section, which is in the form of a truncated cone at least in the region of the compressor chamber. As a result of this form of the compressor chamber and of the rotor, acceleration of the solid/liquid suspension flowing through the compressor chamber is achieved in a simple manner. Moreover, shear forces can be introduced into the suspension by way of the third rotor section in the form of a truncated cone, the homogeneity of the suspension being improved as a result. The rotor may also comprise a plurality of sections in truncated cone form, which may each have different cone angles. Alternatively, the rotor may also be of pear-shaped form with curved surfaces. When the rotor extends from the inlet region of the mixing device to its outlet region, an annular gap which tapers between the inlet region and the outlet region of the mixing device can be formed between the rotor and a housing of the mixing device, an inner housing wall and the corresponding truncated conic surface of the rotor preferably extending at an acute angle of from 3° to 8° relative to one another.

The mixing device according to the invention preferably comprises a first detection device for detecting the flow speed of the liquid in the acceleration chamber and/or a second detection device for detecting the flow speed of the suspension in the compressor chamber, as well as a first adjusting device for adjusting the speed of rotation of the rotor in dependence on the detected flow speed(s). Detection of the flow speed of the liquid in the acceleration chamber and the corresponding adjustment of the rotor speed allows the rotary movement of the solid particles in the solid supply chamber to be matched to the rotary movement of the liquid in the acceleration chamber. By measuring the flow speed of the suspension in the compressor chamber and adjusting the rotor speed accordingly, the flow speed of the suspension in the compressor chamber can be monitored and adjusted, so that it is possible to ensure that the suspension in the compressor chamber is accelerated to a sufficiently high speed to ensure correct operation of the mixing device.

The adjusting device preferably adjusts the speed of rotation of the rotor so that it corresponds to the flow speed of the liquid in the acceleration chamber. In that manner, it is possible to impart to the solid particles in the solid supply chamber a rotary movement that is synchronous with the rotary movement of the liquid in the acceleration chamber, so that a laminar flow forms in the mixing chamber. Moreover, "spraying" of the liquid as it passes from the acceleration chamber to the mixing chamber can be avoided, so that the formation of deposits or incrustations on the walls of the mixing device by rapidly drying liquids is prevented. The application of a parting coating, such as, for example, a Teflon coating, to the walls is therefore no longer absolutely necessary.

Web-like feed devices are preferably arranged on the third rotor section. The use of such feed devices is advantageous especially when processing low viscosity suspensions, because they lead to an increase in the starting resistance and hence to increased acceleration and improved homogeneity of the suspension in the compressor chamber. The feed devices preferably extend in the region of the compressor chamber at an angle of from 15° to 45° relative to the rotor axis. In order to match the energy that is introduced to the viscosity of the suspension to be processed and in order further to improve the homogeneity of the suspension in the compressor chamber, the feed devices may each be provided with bores. The feed devices may also extend over the entire axial length of the rotor. In order to improve the intake behaviour of the dry materials, the feed elements are then preferably inclined in the direction of rotation by an angle of from 15° to 45° relative to the rotor axis in the region of the solid supply chamber and are of greater height there than in the compressor chamber. As a result, the distance between the feed devices and an inner housing wall can be kept constant, regardless of whether the annular gap formed between the rotor and the housing tapers in the direction towards the outlet region of the mixing device.

In a preferred embodiment of the mixing device according to the invention, the rotor is axially displaceable. By an axial displacement of the rotor, the cross-section of the compressor chamber and hence the shear forces introduced into the suspension in the compressor chamber can be varied in dependence on the viscosity of the suspension to be processed. Furthermore, the axial displaceability of the rotor can counteract damage to the mixing device by foreign bodies contained in the solid.

The mixing device according to the invention may also comprise a third detection device for detecting the pressure prevailing in the solid supply chamber, and a second adjusting device for adjusting the metering speed(s) of the solid supply device and/or the liquid supply device. The purpose of such an arrangement is to prevent the mixing device from overflowing, because it enables appropriate adjustment of the metering speed(s) of the solid supply device and/or of the liquid supply device in the case of, for example, a pressure rise in the solid supply chamber owing to saturation of the liquid with the supplied solid. Interruption of the supply of solid is also obtained as protection against running dry.

According to a preferred further development of the method according to the invention, the liquid surface current in the mixing chamber is substantially equal to the specific particle surface of the solid particles introduced into the mixing chamber.

A vertical flow speed of the suspension in the mixing chamber is preferably at least from 1 to 2 m/s, so that a surface exchange of at least from 1 to 2 $m^2/s$ is obtained.

Various embodiments of the mixing device according to the invention are explained in greater detail hereinbelow with reference to the attached diagrammatic Figures, in which.

Figure 1:
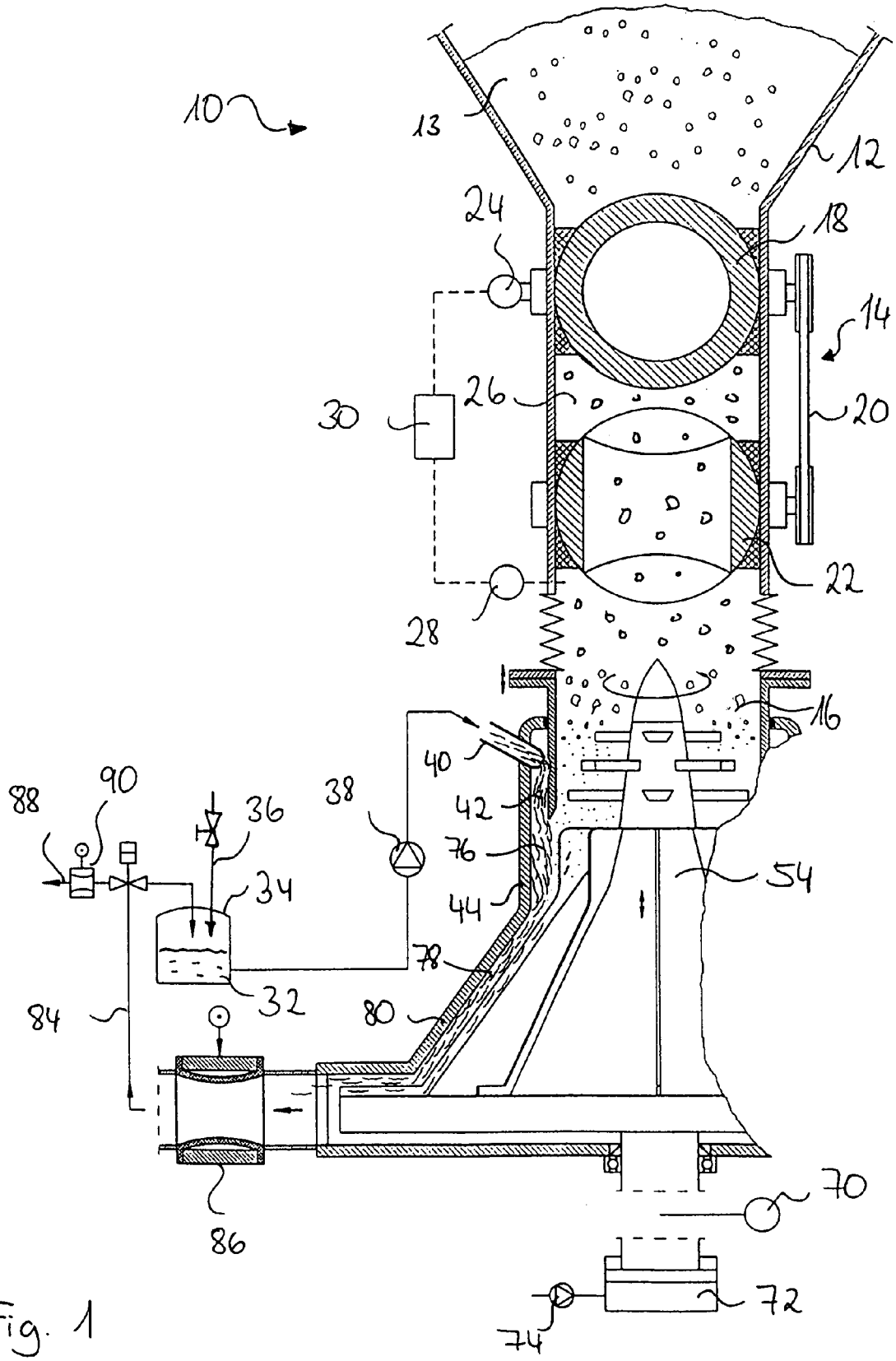
FIG. 1 shows a diagrammatic view of a first embodiment of the mixing device according to the invention.

FIG. 1 shows a device, generally designated 10, for mixing a solid with a liquid. The device comprises a supply vessel 12 containing loose solid 13 which is introduced into a solid supply chamber 16 by means of a pulsed feeding device 14.

The pulsed feeding device 14 has a first ball valve 18 which is synchronised with a second ball valve 22 by way of a chain drive 20 and is driven by a drive motor 24. Between the first and second ball valves 18, 22 there is an intermediate chamber 26. When the first ball valve 18 is in its open position, the intermediate chamber 26 is charged with the loose solid 13 contained in the supply vessel 12, while the second ball valve 22 seals the solid supply chamber 16 from the surrounding atmosphere. The second ball valve 22 is then opened, as is shown in the drawing, so that the loose solid 13 located in the intermediate chamber 26 is emptied into the solid supply chamber 16. The first ball valve 18 is then in its closed position.

In order to adjust the metering speed of the pulsed feeding device 14, there are provided a pressure measuring device 28 for detecting the pressure in the solid supply chamber 16, and an adjusting device 30, which adjusts the output of the drive motor 24 in dependence on the pressure detected by the pressure measuring device 28. If the pressure in the solid supply chamber 16 increases, the adjusting device 30 adjusts the output of the drive motor 24 so that the metering speed of the pulsed feeding device 14 is reduced. The adjusting device 30 can additionally be connected to the pump 38 by way of a connecting line, which is not shown in the Figure, and can adjust the metering speed of the liquid 32 conveyed to the acceleration chamber 42 in dependence on the pressure in the solid supply chamber 16 detected by the pressure measuring device 28.

A liquid 32 to be mixed with the loose solid 13 is located in a container 34 into which one or more liquid components are introduced by way of a metering pipe 36. On the discharge side of the container 34, a pump 38 is arranged in a supply line 37, which pump conveys the liquid 32, under pressure, from the container 34 to an inlet nozzle 40.

Figure 2:
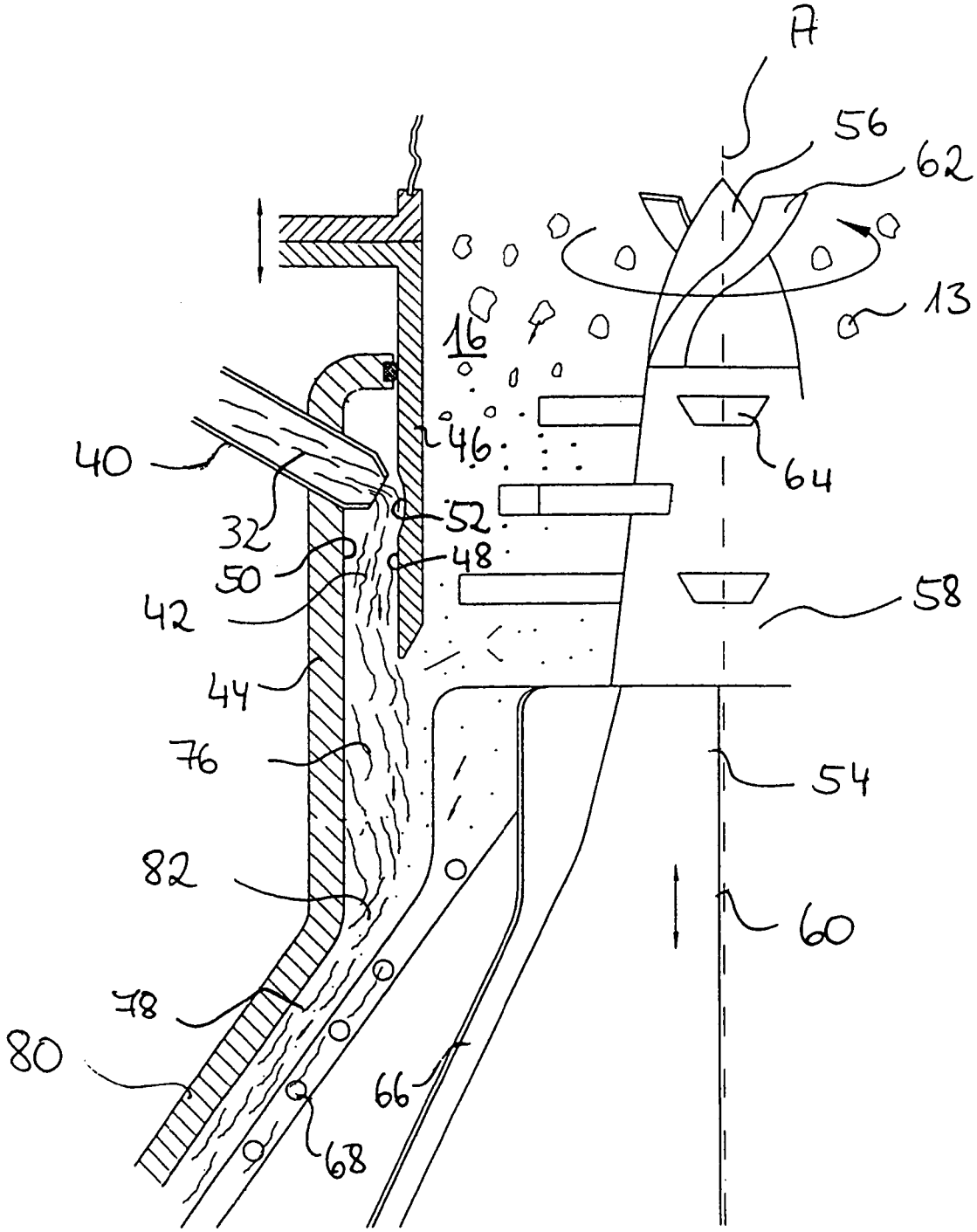
FIG. 2 shows a portion of the first embodiment of the mixing device according to the invention shown in FIG. 1.

As will be seen in FIG. 2, the liquid 32 flows from the inlet nozzle 40 into an acceleration chamber 42. The inlet nozzle 40 is arranged tangentially relative to a housing wall 44 and hence tangentially relative to the direction of flow of the liquid 32 in the acceleration chamber 42 and is inclined in the direction of flow. The acceleration chamber 42 has a circular cross-section and is delimited by the housing wall 44 and by an axially displaceable separating wall 46 which separates the acceleration chamber 42 from the solid supply chamber 16. Recesses 52 are provided on a surface 48 of the separating wall 46 that faces the acceleration chamber 42 and on a surface 50 of the housing wall 44 that faces the acceleration chamber 42, which recesses 52 extend spirally and are inclined in the direction of flow and each form a flow channel for the liquid 32 to which a rotary movement has been imparted.

A rotor 54 which is displaceable along a rotor axis A has a first, a second and a third rotor section 56, 58, 60, the first rotor section 56 facing the pulsed feeding device 14 and being arranged in the solid supply chamber 16. The first rotor section 56 is also provided with a pre-treatment head 62. The second rotor section 58 is likewise arranged in the solid supply chamber 16 and has a plurality of pulverising blades 64 extending perpendicularly to the rotor axis A. A plurality of feed webs 66, some of which, are provided with bores 68, are secured to the third rotor section 60, which is in the form of a truncated cone. As is shown in FIG. 1, the rotor 54 is driven by a rotor drive motor 70. The axial displacement of the rotor 54 is effected by means of a hydraulic pump 74 connected to a piston 72.

On the discharge side of the acceleration chamber 42 there is a mixing chamber 76 and a compressor chamber 78. The compressor chamber 78 has a cross-section in the form of an annular gap and is delimited by a section 80 of the housing wall 44 in the form of a truncated cone, and by the third rotor section 60 in the form of a truncated cone.

By the introduction of the pressurised liquid 32 through the inlet nozzle 40, which is arranged tangentially relative to the housing wall 44 and is inclined in the direction of flow, a rotary movement is imparted to the liquid 32 in the acceleration chamber 42 and the liquid 32 is accelerated to a pre-determined speed. A rotary movement is likewise imparted in the solid supply chamber 16, by the rotor 54, to the solid 13 supplied by the pulsed feeding device 14, powder agglomerates present in the solid 13 first being roughly comminuted by the pre-treatment head 62 and then being finely pulverised by the pulverising blades 64. The speed of the liquid 32 in the acceleration chamber 42 is detected by means of a flow speed measuring device (not shown in the drawing). An adjusting device (likewise not shown) adjusts the speed of rotation of the rotor 54 so that it corresponds to the speed of the liquid 32 in the acceleration chamber 42. As a result, synchronous rotary movements are imparted to the liquid 32 in the acceleration chamber 42 and to the solid 13 in the solid supply chamber 16, so that a laminar flow is obtained in the mixing chamber 76.

The liquid 32 flows from the acceleration chamber 42, with a constant speed of rotation, into the mixing chamber 76, where it is mixed with the solid particles 13, the solid particles 13 being in the form of finely pulverised agglomerates, but not in the form of primary particles. By means of the centrifugal forces arising as a result of the rotary movement, the powder particles 13 are transported in the direction of the layer of liquid flowing along the housing wall 44. Owing to the surface resistance of the housing wall 44, deep eddies form in the layer of liquid, by which the layers of liquid flowing directly along the housing wall 44 are also transported in the direction of the surface of the liquid flow facing the solid supply chamber 16, where they are available for mixing with the supplied solid particles 13. Axial displacement of the separating wall 46 (so-called auto bulkhead adjustment) allows the flow paths of the liquid 32 in the acceleration chamber 42 or of the suspension in the mixing chamber 76 to be varied in dependence on the viscosity and the flow behavior of the liquid 32 or of the suspension, in order to prevent an interruption of flow, for example.

The solid/liquid suspension flows from the mixing chamber 76 into the compressor chamber 78, where it is accelerated by means of the third rotor section 60 in the form of a truncated cone. Owing to the increased flow speed of the suspension in the compressor chamber 78, a suction effect (jet pump effect) is created in an entry region 82 of the compressor chamber 78 as a result of the reduced static pressure owing to the increase in the flow speed, so that the air in the capillaries of the fine powder agglomerates 13 is aspirated. Because the pulsed feeding device 14 also seals the solid supply chamber 16 from the surrounding atmosphere, a low pressure forms in the solid supply chamber 16, so that the supplied solid particles 13 are already de-aerated in the solid supply chamber 16. As a result, wetting of the de-aerated powder particles 13 with the liquid 32 in the mixing chamber 76 is enhanced, so that the powder particles 13 are already largely wetted with the liquid when they enter the compressor chamber 78. By means of a flow speed measuring device (not shown in the drawing), the speed of the suspension in the compressor chamber 78 is detected. An adjusting device (also not shown) adjusts the speed of rotation of the rotor 54, in order to ensure that the suspension in the compressor chamber 78 is accelerated to a sufficiently high speed to ensure correct operation of the mixing device 10 and to prevent splashing or spraying by setting a relative speed equal to zero.

Owing to the low pressure in the solid supply chamber 16, the air in the capillaries of the supplied powder agglomerates 13 expands, so that the agglomerates 13 are at least partly destroyed. In addition, the air flowing to the entry region 82 of the compressor chamber 78 transports the powder particles 13 into the mixing chamber 76, where they enter the laminar flow path as a result of the centrifugal forces.

An increased dynamic pressure prevails in the compressor chamber 78 owing to the increased flow speed of the suspension. As a result, the liquid in the compressor chamber 78 is pressed, under pressure, into the de-aerated capillaries of the powder agglomerates. Furthermore, shear forces are introduced into the suspension in the compressor chamber 78 by way of the rotor section 60 in the form of a truncated cone, as a result of which the homogeneity of the suspension is increased. The axial displacement of the rotor 54 enables the cross-section of the compressor chamber 78 and hence the shear forces introduced into the suspension in the compressor chamber 78 to be varied in dependence on the viscosity of the suspension to be processed.

As will be seen in FIG. 1, the suspension flows from the compressor chamber 78 into a first outlet pipe 84. A pressure controller 86 is provided in the first outlet pipe 84 for generating the necessary pressure in the compressor chamber 78 for complete wetting of the powder particles 13 even in the case of low pipe resistances and low viscosity suspensions. The suspension can be discharged from the first outlet pipe 84 into a second outlet pipe 88, in which there is a further pressure controller 90 for maintaining a constant pressure. However, it is also possible to guide the suspension into the container 34 and feed it from there in the circuit back into the acceleration chamber 42.

Figure 3:
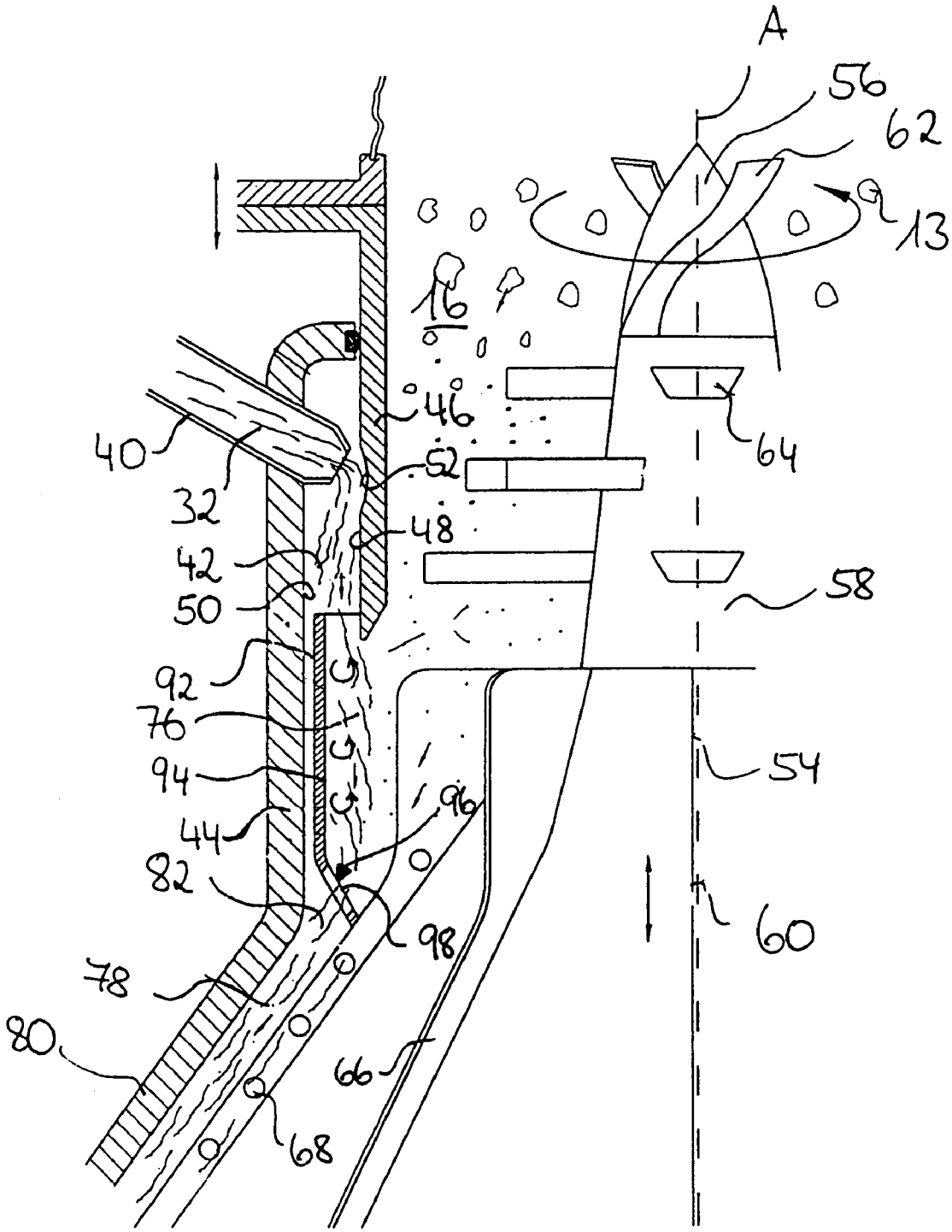
FIG. 3 shows a portion of a second embodiment of the mixing device according to the invention.

FIG. 3 shows a portion of an alternative embodiment of the mixing device 10, in which the rotor 54 has a fourth rotor section 92. The fourth rotor section 92 consists of a first partial section 94, which extends parallel to the rotor axis A, and a second partial section 96, which extends at an angle of about 60° relative to the rotor axis A.

In dependence on the position of the axially displaceable separating wall 46, the first partial section 94 forms a rotatable outer wall which delimits the entirety of the mixing chamber 76 and at least part of the acceleration chamber 42 and by means of which the speed of rotation of the liquid 32 in the acceleration chamber 42 and/or of the suspension in the mixing chamber 76 can be maintained. In order to allow the suspension to pass unhindered from the mixing chamber 76 into the compressor chamber 78, the second partial section 96 is provided with a through-opening 98 for the suspension.

Figure 4:
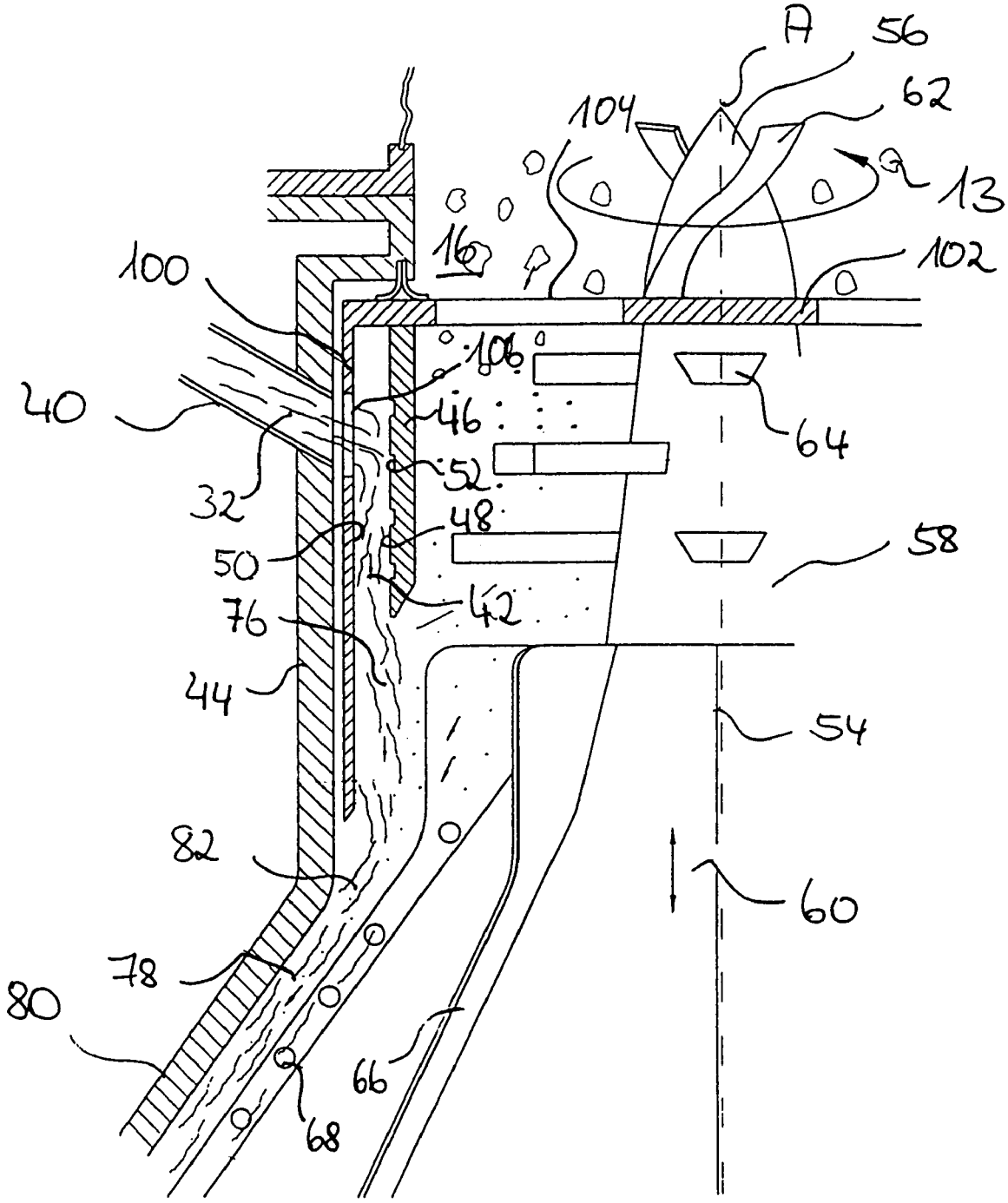
FIG. 4 shows a portion of a third embodiment of the mixing device according to the invention.

In the further embodiment of the mixing device 10 shown in FIG. 4, the separating wall 46 and a wall 100 arranged parallel to the housing wall 44 are connected to a fifth rotor section 102 which extends perpendicular to the rotor axis A. The wall 100 extends along the acceleration chamber 42 and along a substantial portion of the mixing chamber 76. In contrast to the embodiments shown in FIGS. 1 to 3, axial displacement of the separating wall 46 is not possible in the mixing device 10 shown in FIG. 4. For the unhindered passage of the solid particles 13, the fifth rotor section 102 is provided with a through-opening 104 for the solid, while the wall 100 has a liquid inlet opening 106 for the unhindered entry of the liquid 32 into the acceleration chamber 42. The rotatable arrangement of the wall 100 and of the separating wall 46 enables the liquid 32 in the acceleration chamber 42 to be accelerated particularly effectively and the speed of rotation of the suspension in the mixing chamber 76 to be maintained, so that the mixing device 10 is suitable especially for the processing of highly viscous or intrinsically viscous liquids and suspensions.

Figure 5:
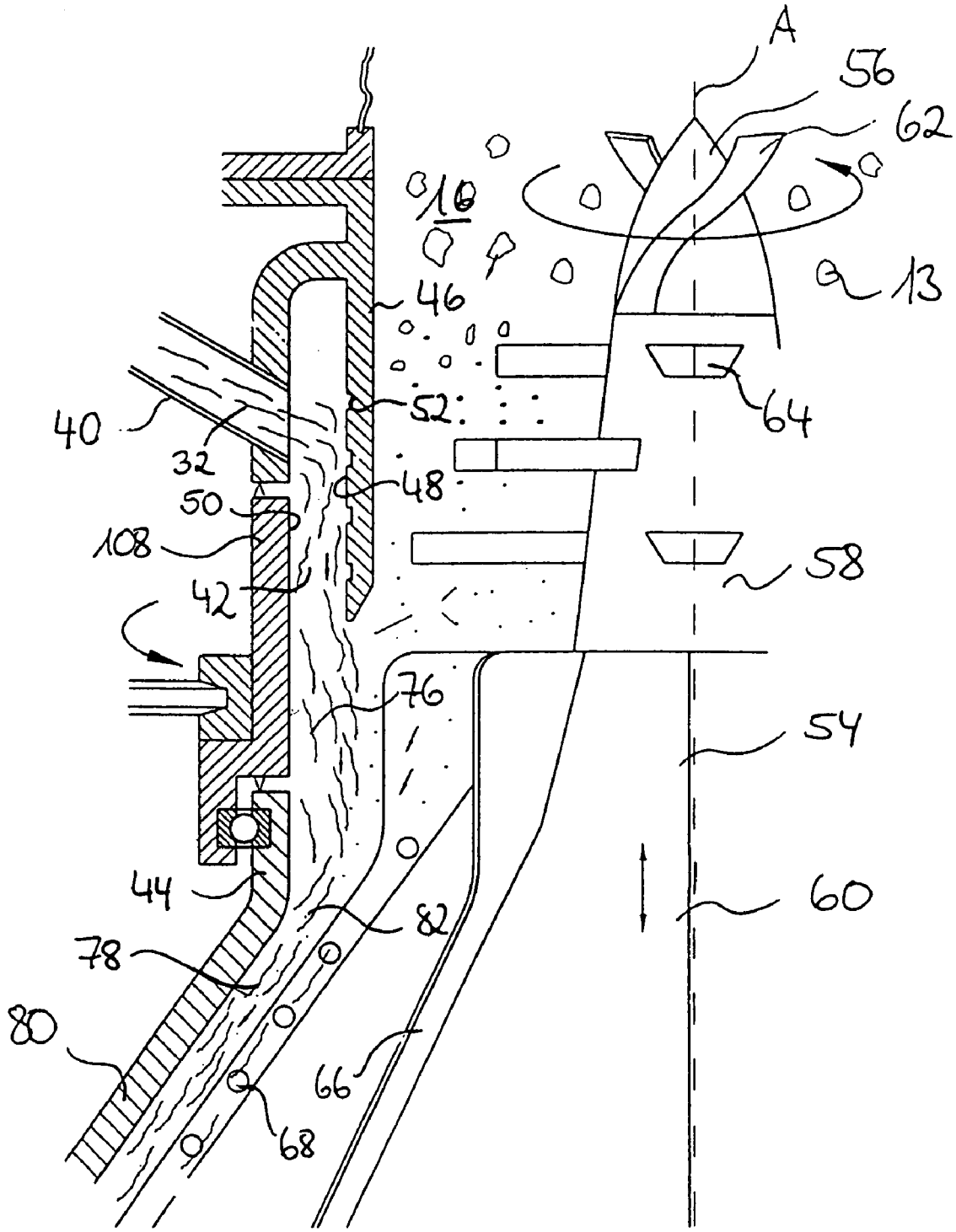
FIG. 5 shows a portion of a fourth embodiment of the mixing device according to the invention.

The embodiment of the mixing device 10 shown in FIG. 5 has a rotatable section 108 of the housing wall 44, which rotatable section 108 extends over partial regions of the acceleration chamber 42 and of the mixing chamber 46. In this embodiment too, axial displacement of the separating wall 46 is not possible. The drive for the rotatable section 108 of the housing wall 44 can be coupled with the rotor drive 70.

However, it is also possible to provide a drive for the rotatable section 108 of the housing wall 44 that is separate from the rotor drive 70.

Figure 6:
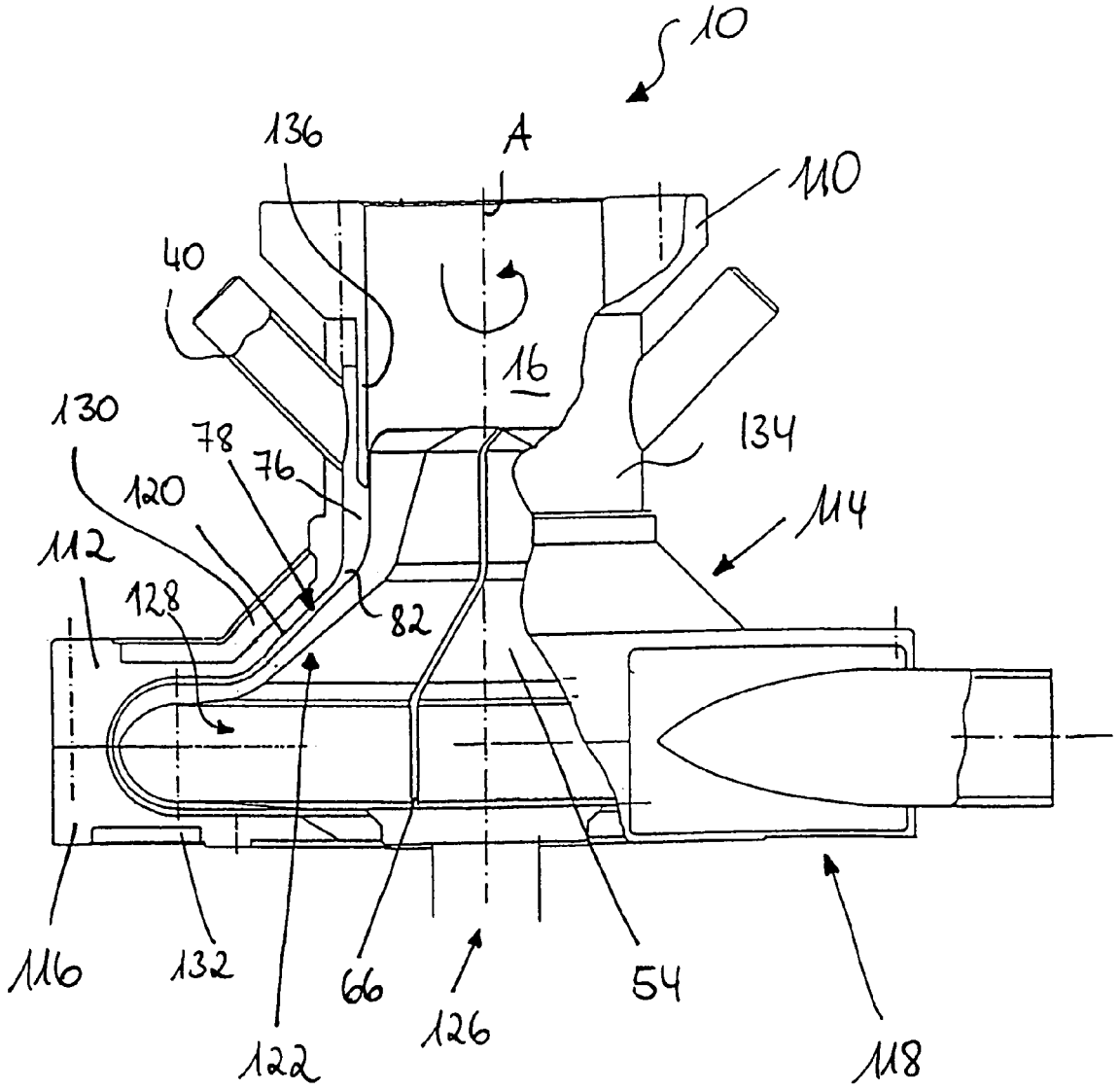
FIG. 6 shows a portion of a fifth embodiment of the mixing device according to the invention.

The embodiment of the mixing device 10 shown in FIG. 6 has a solid supply chamber 16 and a filling shaft 110 having a funnel-shaped inlet opening. The filling shaft 110 sits in a cover 112 or a housing 114 of the mixing device 10 and is screwed thereto. A radially arranged material outlet 118 is provided in a base 116 of the housing 114, by way of which outlet 118 the mixed material produced in the compressor chamber 78 flows out.

The rotor 54 of the mixing device 10 differs from the rotors shown in FIGS. 1 to 5 in that it does not have a first rotor section provided with a pre-treatment head or a second rotor section equipped with pulverising blades. Instead, the rotor 54 is in the form of a truncated cone, so that the compressor chamber 78 in the form of an annular gap is delimited by an inner wall 120 of the cover 112 and a surface, in the form of a truncated cone, of a middle partial region 122 of the rotor 54. The inner wall 120 of the cover 112 and the truncated-cone-shaped surface of the rotor 54 extend in the partial region 122 at an angle of 5°, so that the annular gap forming the compressor chamber 78 tapers from the entry region 82 of the compressor chamber in the direction towards the material outlet 118. The distance of the feed devices 66, which are in the form of webs in the region of the compressor chamber 78, relative to the inner wall 120 of the cover 112 remains constant. The rotor 54 has the greatest diameter in an outlet region 128. The sections of the feed devices 66 arranged in the outlet region 128 of the rotor 54 accordingly produce a higher centrifugal flow, in relation to the mixing chamber 76, and assist residue-free discharge.

The rotor 54 projects with its upper partial region 124 into the solid supply chamber 16 to the lower end of the filling shaft 110. The feed webs 66 here extend close to a wall 136 of the filling shaft 110. On rotation of the rotor 54, which is connected by way of a shaft 126 to a drive, the feed webs 66, which feed in the direction of the rotor axis A to the material outlet 118, prevent liquid from entering the inside of the filling shaft 10. In order to improve the intake action, the feed webs 66 are inclined by about 45° in the direction of rotation at the end of the rotor 54 facing the solid supply chamber 16.

As in the embodiments shown in FIGS. 1 to 5, the supply of liquid takes place through inlet nozzles 40, which are formed in a cap 134 of the cover 112. The inlet nozzles 40 are located opposite an end of the wall 136 of the filling shaft 110 that faces the compressor chamber 78. Owing to the arrangement of the inlet nozzles 40 tangentially and inclined in the direction of flow, the liquid flows along the wall 136 of the filling shaft 110 along a spiral line in the direction towards the mixing chamber 76. Supply of the liquid can be carried out by way of one or more inlet nozzles 40 distributed around the cap 134, the introduction of various liquid additives also being possible, if required.

In order to reduce the process heat that is generated, which would be transferred to the mixed material, cooling chambers 130, 132 are arranged in the cover 112 and in the base 116. The cooling agent flowing through the chambers 130, 132 serves to cool the mixed material during the dispersion operation in the compressor chamber 78 and the outlet region 128, which takes place under considerable pressure.

Figure 7:
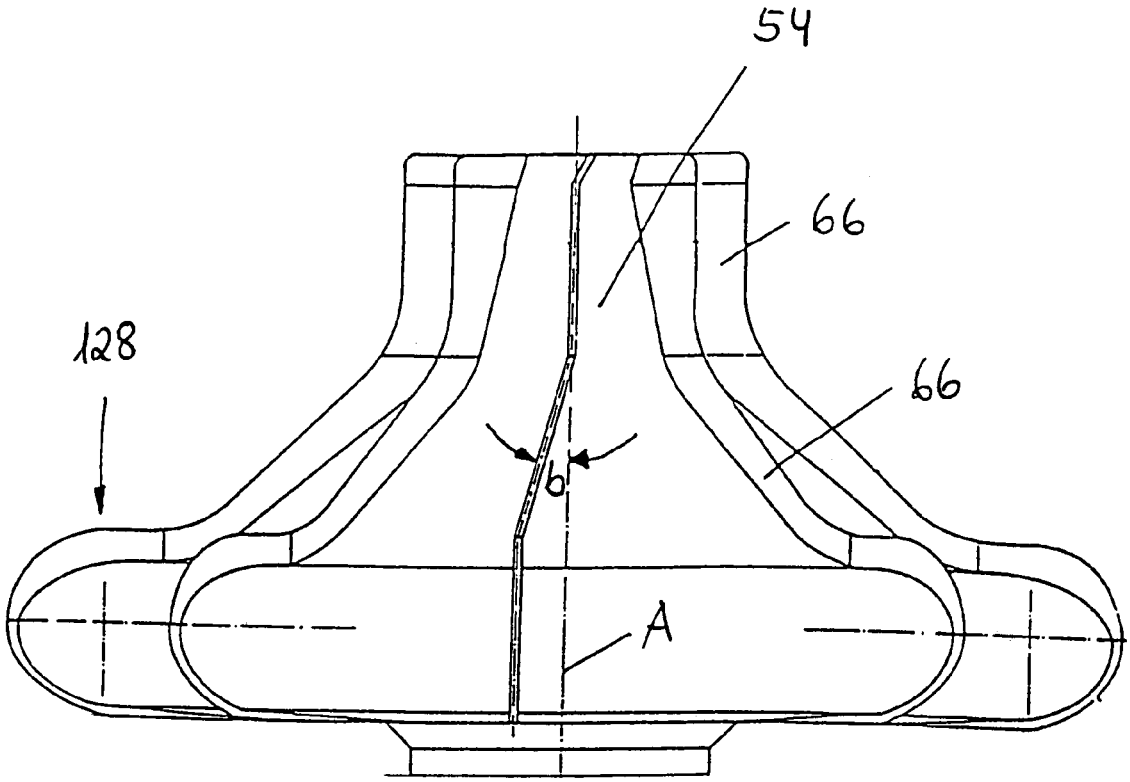
FIG. 7 shows a cross-sectional view of the rotor of the mixing device shown in FIG. 6.
Figure 8:
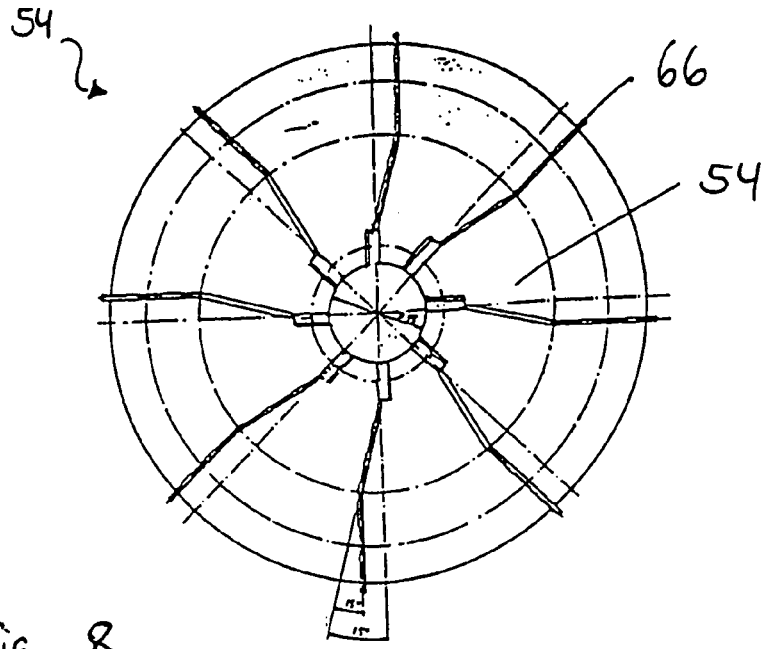
FIG. 8 shows a plan view of the rotor shown in FIG. 7.

The representation shown in FIGS. 7 and 8 of the rotor 54 used in the mixing device according to FIG. 6 illustrates the arrangement of the web-like feed devices 66. In the embodiment of the rotor 54 shown therein, eight feed webs 66 are distributed over the surface of the rotor 54 at 45° intervals. The inclination of the feed webs 66 relative to the rotor axis A is different in the individual effective regions of the rotor 54. In the region of the rotor 54 having the smallest cross-section, the feed webs 66 are inclined by 45° in the direction of rotation and have their greatest height. In the mixing chamber 76, in which the liquid is mixed with the dry material, the feed webs 66 extend along the rotor axis A. In the compressor chamber 78 itself, the feed webs 66 are inclined by 30° relative to the rotor axis A.

In the outlet region 128 of the rotor 54, the feed webs 66 run axis-parallel to the rotor axis A along the entire outer semi-circular cross-section of the rotor 54.

The invention claimed is:

1. Device (10) for mixing a pulverulent or granular solid (13) with a liquid (32), having:

at least one solid supply device (14), at least one liquid supply device (37, 38, 40), an acceleration chamber (42), in which a rotary movement is imparted to the supplied liquid (32) and the liquid (32) is accelerated to a pre-determined speed, a solid supply chamber (16), in which a rotary movement is imparted to the supplied solid particles (13), a mixing chamber (76) for mixing the solid particles (13) with the liquid (32) to form a suspension, while maintaining the rotary movement generated previously in the acceleration chamber (42) and the solid supply chamber (16), a compressor chamber (78), adapted to accelerate the suspension that is rotating so that a suction effect is generated in an entry region (82) of the compressor chamber (78), which suction effect at least substantially de-aerates the supplied loose solid (13), a rotor (54) having a first rotor section (56) located in said solid supply chamber (16) with a pre-treatment head (62) contacting, roughly comminuting, and accelerating the supplied solid particles in said solid supply chamber prior to the supplied solid particles flowing to said mixing chamber (76), and a first detection device for detecting the flow speed of the liquid (32) in the acceleration chamber (42) and/or a second detection device for detecting the flow speed of the suspension in the compressor chamber (78) and a first adjusting device for adjusting the speed of rotation of the rotor (54) in dependence on the detected flow speed(s).

2. Device according to claim 1, characterised in that the solid feed device (14) comprises a pulsed feeding device for conveying the solid (13) and sealing the solid supply chamber (16) from the surrounding atmosphere.

3. Device according to claim 1, characterised in that the liquid supply device (37, 38, 40) comprises at least one inlet nozzle (40), which is arranged tangentially relative to the direction of flow of the liquid (32) in the acceleration chamber (42) and is inclined in the direction of flow, and a device (38) for pressurising the liquid (32) to be supplied.

4. Device according to claim 1, characterised in that the acceleration chamber (42) has a substantially circular cross-section and is separated from the solid supply chamber (16) by a separating wall (46).

5. Device according to claim 4, characterised in that flow channels (52) which extend spirally and are inclined in the direction of flow are formed on a surface (48) of the separating wall (46) that faces the acceleration chamber (42) and/or on a surface (50), facing the acceleration chamber (42), of an outer wall (44; 92; 100) delimiting at least part of the acceleration chamber (42).

6. Device according to claim 4, characterised in that the separating wall (46) and/or an outer wall (92; 100; 108) delimiting at least part of the acceleration chamber (42) and/or an outer wall (92; 100; 108) delimiting at least part of the mixing chamber (76) are rotatable.

7. Device according to claim 4, characterised in that the separating wall (46) is axially displaceable.

8. Device according to claim 4, characterised in that the separating wall (46) and/or an outer wall (92; 100) delimiting at least part of the acceleration chamber (42) and/or an outer wall (92; 100) delimiting at least part of the mixing chamber is/are rotatable and connected to a said rotor (54).

9. Device according to claim 1, characterized in that said rotor (54) has a second and a third rotor section (58, 60).

10. Device according to claim 9, characterised in that at least part of the second rotor section (58) extends into the solid supply chamber (16) and is provided with pulverising blades (64).

11. Device according to claim 9, characterised in that the compressor chamber (78) has a cross-section in the form of an annular gap and is delimited by a section (80) of an outer wall (44), which section (80) has the form of a truncated cone, and by the third rotor section (60) which is in the form of a truncated cone at least in the region of the compressor chamber (78).

12. Device according to claim 9, characterised in that a first adjusting device adjusts the speed of rotation of the rotor (54) so that it corresponds to the flow speed of the liquid (32) in the acceleration chamber (42).

13. Device according to claim 9, characterised in that feed devices (66) which are in the form of webs and are provided with bores (68) are provided on the third rotor section (60).

14. Device according to claim 9, characterised in that the rotor (54) is axially displaceable.

15. Device according to claim 9, characterised in that it comprises a third detection device 28 for detecting the pressure prevailing in the solid supply chamber (16), and a second adjusting device (30) for adjusting the metering speed(s) of the solid supply device (14) and/or of the liquid supply device (37, 38, 40).

16. Method of mixing a pulverulent or granular solid (13) with a liquid (32), comprising the following steps:

providing a supply of the solid (13), providing a supply of the liquid (32), providing an acceleration chamber (42), a solid supply chamber (16), and a mixing chamber (76), providing a rotor (54) having a first rotor section (56) located in said solid supply chamber (16) with a pre-treatment head (62), contacting, roughly comminuting, and accelerating the supplied solid particles in said solid supply chamber prior to the supplied solid particles flowing to said mixing chamber (76), production of a rotary movement of the supplied liquid (32) and acceleration of the liquid (32) to a predetermined speed in an acceleration chamber (42), production of a rotary movement of the supplied solid particles (13) in a solid supply chamber (16), mixing of the solid particles (13) with the liquid (32) to form a suspension while maintaining the rotary movement previously generated, in a mixing chamber (76), and accelerating the rotating suspension in the compression chamber (78) so that a suction effect is generated in the entry region (82) of the compressor chamber (78) which suction effect at least substantially de-aerates the supplied loose solid (13).

17. Method according to claim 16, characterised in that the liquid surface flow in the mixing chamber (76) substantially corresponds to the particle surface flow of the solid particles (13) introduced into the mixing chamber (76).

18. Method according to claim 16, characterised in that a vertical flow speed of the suspension in the mixing chamber (76) is at least from 1 to 2 m/s.

* * * * *